US005228413A

United States Patent [19]

Tam

[11] Patent Number: 5,228,413

[45] Date of Patent: Jul. 20, 1993

[54] MULTIPLE BOILER

[76] Inventor: Raymond T. Tam, 1860 Moore Avenue, Burnaby, B.C., Canada, V5B 4N3

[21] Appl. No.: 858,386

[22] Filed: Mar. 25, 1992

[51] Int. Cl.[5] ..... F22B 5/00

[52] U.S. Cl. ..... 122/17; 122/13.2; 122/14; 122/248; 122/249; 122/250 R; 126/361; 126/362

[58] Field of Search ..... 122/248, 249, 250, 17, 122/33, 14, 13.2; 110/163; 126/361, 362

[56] References Cited

U.S. PATENT DOCUMENTS

| | | | |
|---|---|---|---|
| 2,286,677 | 6/1942 | Greth | 122/169 |
| 2,506,120 | 5/1950 | Turner | 122/17 X |
| 2,937,625 | 5/1960 | Meyers | 122/33 |
| 4,157,706 | 6/1979 | Gaskill | 126/271 |
| 4,222,350 | 9/1980 | Pompei et al. | 122/32 |
| 4,226,195 | 10/1980 | Lindroos | 110/234 |
| 4,282,421 | 8/1981 | Hadar | 122/13.2 X |
| 4,360,003 | 11/1982 | Hardy | 122/33 X |
| 4,672,919 | 6/1987 | Staats | 122/17 X |
| 4,676,119 | 6/1987 | Daugirda et al. | 122/18 X |
| 4,679,528 | 7/1987 | Krans et al. | 122/367 C |
| 4,685,444 | 8/1987 | Dürrenberger | 122/14 X |
| 4,770,160 | 9/1988 | Schimmeyer | 110/163 X |
| 4,823,770 | 4/1989 | Loeffler | 122/17 X |

*Primary Examiner*—Edward G. Favors
*Attorney, Agent, or Firm*—Townsend and Townsend Khourie and Crew

[57] ABSTRACT

A multiple boiler has at least two separate heating systems incorporated therein. Whereas boilers with two heating supplies have been known, they have been complicated systems that require heating to occur outside a water tank. The multiple boiler has an insulated water tank with a heater to heat the water in the tank without circulating water outside the tank. At least one circulating coil is located in the tank in heat exchange relationship with water in the tank.

28 Claims, 6 Drawing Sheets 39
39A
38
36
10
34
22
42
18
14
32
40
20
12
30
25
44
24
16
1A
28
26

39
36
60
62
10
34
22
52
18
50
54
12
30
32
42
40
25
44
16
24
1A
66
28
68
70

MULTIPLE BOILER

TECHNICAL FIELD

The present invention relates to boilers and more specifically to hot water boilers having an insulated water tank with a separate liquid heating coil immersed within the tank.

BACKGROUND ART

Boiler systems wherein water tanks are heated either by interior means or by exterior means are well known. Furthermore, it is known that a hot water boiler may have two separate hot water outlets, one for domestic hot water and the other for a heating system in the building. Examples of such devices are shown in Meyers U.S. Pat. No. 2,937,625 and in Pompei et al U.S. Pat. No. 4,222,350. Both of these systems however show complicated units wherein water or liquid is circulated from a tank and the heating occurs when the water is not in the tank. Such systems are generally expensive and complex.

DISCLOSURE OF INVENTION

It is an aim of the present invention to provide a simplified hot water apparatus that includes an insulated tank to contain water and a system for heating the water in the tank. The heating of the water occurs only in the tank although the water may circulate to give off heat in a space heating system, or in another embodiment may supply domestic hot water. Inside the tank is at least one separate coil permitting water or other liquid from the outside to circulate through the tank where it is heated by the water in the tank. Hot water from a coil can be used for a space heating system or for a hot water system in the building. In another embodiment, separate coils may be placed within the tank to provide separate sources of hot water or liquid for such diverse functions as heating a swimming pool, hot tub, underground heating coils for driveways, radiant panel heating systems, fan coil heaters and other domestic hot water uses.

The present invention provides a multiple boiler comprising an insulated water tank having a water tank inlet and a water tank outlet, heating means to heat the water in the tank without circulating water outside the tank, at least one circulating coil in the tank, the coil having an inflow and an outflow, the circulating coil in heat exchange relationship with water in the tank.

In a further embodiment there is provided a multiple boiler comprising an insulated water tank having a water tank inlet and a water tank outlet, heating means located beneath the tank to heat water in the tank without circulating water outside the tank, flue column means passing from the bottom of the tank through the tank to the top of the tank for flue gases from the heating means, and at least one circulating coil in the tank the coil having an inflow and an outflow, the circulating coil in heat exchange relationship with water in the tank.

BRIEF DESCRIPTION OF DRAWINGS

In drawings which illustrate embodiments of the present invention.

MODES FOR CARRYING OUT THE INVENTION

Figure 1:
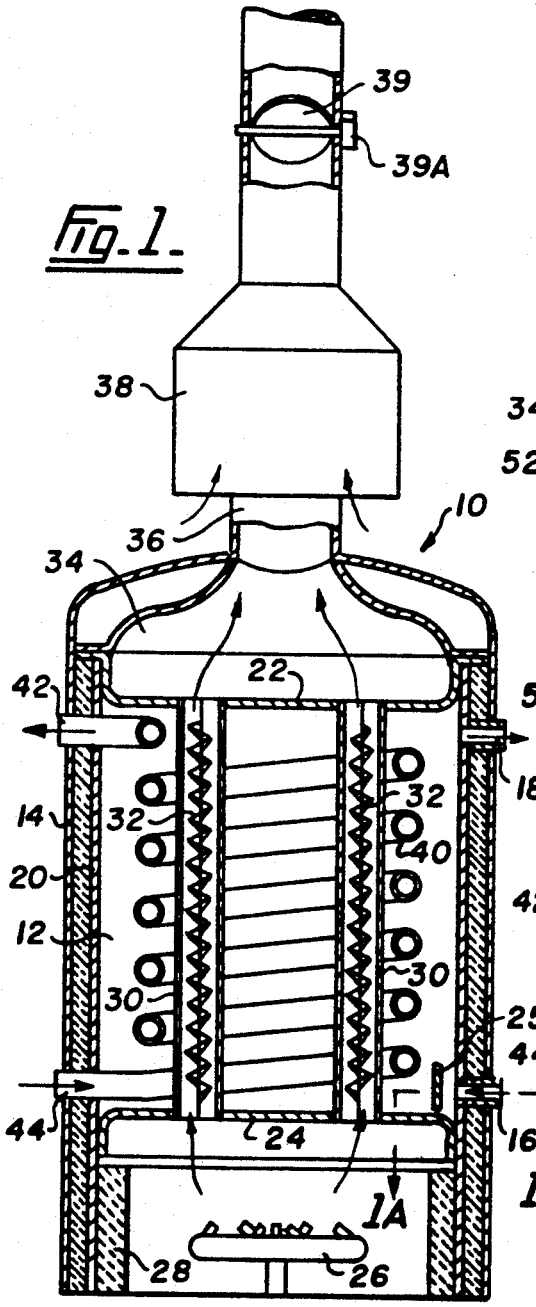
FIG. 1 is an elevational cross-sectional view showing one embodiment of a multiple boiler according to the present invention.

One example of a multiple boiler 10 is shown in FIG. 1 having a tank 12 surrounded by insulation 14. An inlet connection 16 is shown adjacent the bottom of the tank and an outlet connection 18 is shown adjacent the top of the tank. The inlet 16 and outlet 18 may be interchanged provided the water moves through the tank 12. The tank 12 has cylindrical walls 20 with a dished top plate 22 and a dished bottom plate 24. The tank is preferably made by welding, from mild steel, although in domestic hot water heaters stainless steels are satisfactory.

Figure 1A:
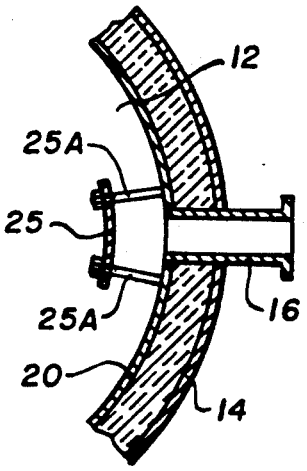
FIG. 1A is a detailed sectional view taken at 1A–1A of FIG. 1.

A baffle 25 is shown in FIG. 1A spaced a short distance from the inlet connection 16 to ensure that a cold flow of water into the tank 12 is diffused and not directed out a circulating coil. The baffle 25 is supported by straps or pins 25A.

Beneath the tank 12 is a gas burner 26 within a refractory ring 28. The gas burner heats the bottom plate 24 of the tank and flue gases pass up through two columns 30 which extend from the bottom plate 24 to the top plate 22 of the tank, passing through the inside of the tank 12. Whereas two columns are shown in FIG. 1, three or more columns may be provided and the diameters of the columns are arranged so that there is a flow of flue gases upwards from the burner 26. A helical ribbon 32 is shown fixed within each flue column 30 to form a turbulator. Thus, the flue gases are in turbulent motion as they pass up through the column 30, which maximize the transfer of heat from the flue gases to the outside walls of the columns 30 and hence to the water in the tank 12. There are different types of turbulators that may be used to transfer heat from the flue gases to water in the tank 12. In another embodiment a flat ribbon is placed in the centre of the column 30 and flaps are stamped out on each side so the gases follow a tortuous path through the column 30.

A flue gas collection area 34 is provided above the top 22 of the tank 12. The flue gases assemble in here and then exit through the stack 36. A draft hood 38 is provided on the stack to assist in providing a draw for the flue gases, and maintain steady combustion. A vent damper 39 is provided in the stack 36 above the draft hood 38. The damper has a motorized operator 39A which closes the damper when the burner 26 is turned off to avoid loss of heat through the stack 36.

A circulating coil 40 is placed within the tank. The coil is helical about a vertical axis and surrounds the flue columns 30. The coil 40 may or may not be in contact with the flue columns but the majority of the heat to the coil 40 is passed through water within the tank 12. The coil 40 has an inflow pipe 44 and an outflow pipe 42, thus the cold water or liquid enters at the bottom and the hot liquid exits at the top. In another embodiment, the inflow pipe 44 and outflow pipe 42 may be reversed.

The number of coils 40 and type of material is made to suit the capacity and use of the boiler. For a closed loop circulation no active oxygen is present in the coils, but for an open circulation system, such as a hot water system, active oxygen is present and this can result in oxidation occurring on metal surfaces, i.e., rust occurring on mild steel. Materials may be plastic, copper, stainless steel, to name but a few of the many suitable materials. Although not shown herein and not included as part of the present invention, a separate pump and hot water storage tank may be provided for a hot water system and for a heating system.

The temperature of the water in the tank cannot exceed the boiling point of the water or other liquid at the particular pressure in the tank, and the thermostats (not shown) are provided to ensure that overheating cannot occur.

Figure 2:
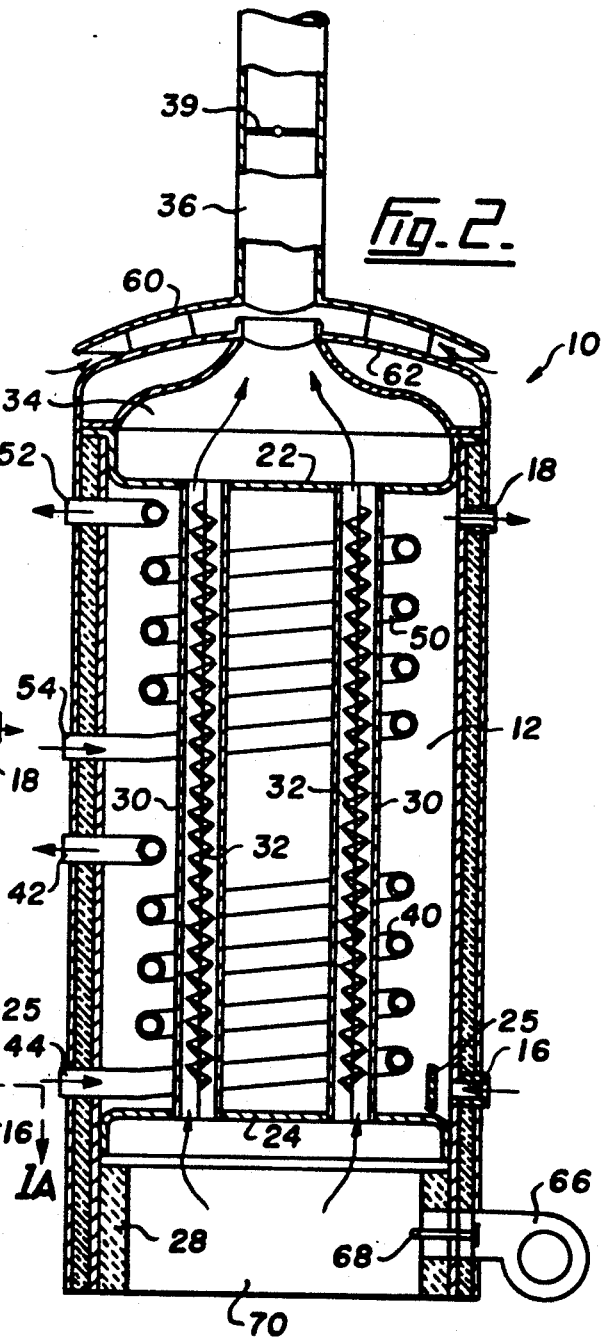
FIG. 2 is an elevational cross-sectional view of another embodiment of a multiple boiler according to the present invention.

FIG. 2 illustrates another embodiment wherein a first coil 40 is positioned in the bottom portion of the tank and a second coil 50 with separate inflow pipe 54 and outflow pipe 52 is provided. Thus, three heating systems are provided within the tank 12 permitting three sources of heat, the first source from the tank 12 itself which may be used for space heating, the second source from the circulating coil 50 for a domestic hot water system, and the third source from the circulating coil 40 for heating in underground pipes extending under a driveway for melting ice, or other domestic uses. If desired a third circulating coil (not shown) may be provided above the coils 40 and 50. If it is desired for instance to provide heat for melting ice under driveways and the like, then the liquid in the pipes need not be water but may be brine or other suitable liquid that has a low freezing point. In this way freezing of the liquid within the pipes does not occur.

A special low profile draft hood 60 is shown in FIG. 2 extending over the top cover 62 of the tank, but may be larger or smaller as desired. This unit is more compact and replaces the draft hood 38 shown in FIG. 1.

The heating unit underneath the tank 12 comprises a fan or blower 66 with a gas or oil injector 68. This is a standard commercially available power burner unit used in hot water heaters and furnaces and provides combustion within the combustion chamber 70 surrounded by the refractory walls 28. The flue gases rise up through flue columns 30 as in the case shown in FIG. 1.

Whereas gas and oil burners are shown, the boiler may be fitted with a fire box for solid fuel burning. Wood, coal or other solid fuels may be used for heating water in the tank 12.

Figure 3:
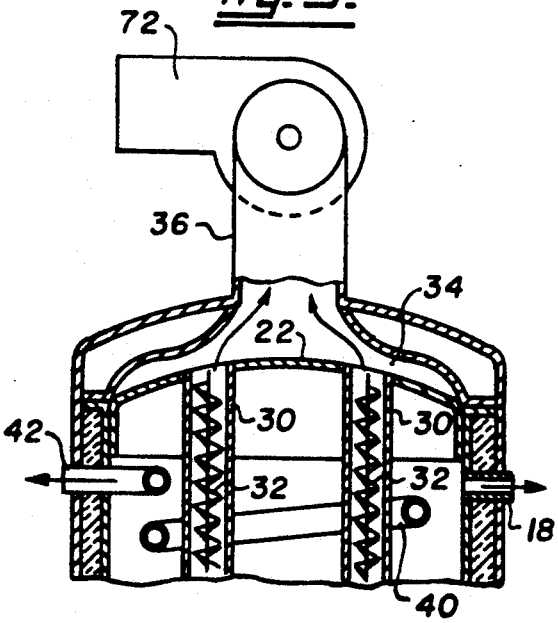
FIG. 3 is a partial elevational cross-sectional view showing one embodiment of a top of a tank.
Figure 4:
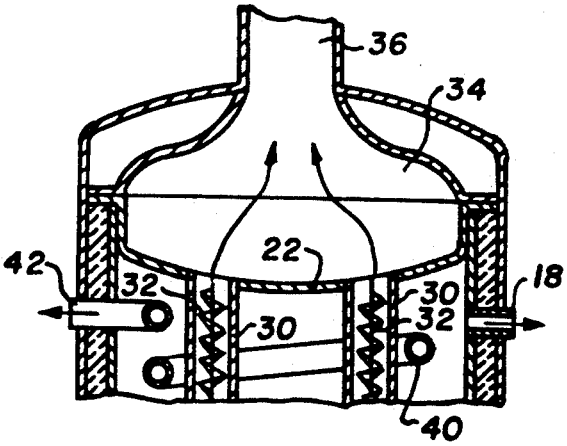
FIG. 4 is a partial elevational cross-sectional view showing another embodiment of a top of a tank.

FIG. 3 illustrates an embodiment wherein the top plate 22 is convex shaped rather than dished as shown in FIGS. 1 and 2, and FIG. 4 shows the top plate 22 concave shaped. Similarly, the bottom plate 24, while not shown, may also be dished as shown in FIGS. 1 and 2 or, alternatively, convex as shown in FIG. 3 or concave as shown in FIG. 4.

An induced draft blower 72 is shown in FIG. 3 mounted on the stack 36 to provide induced draft when the burner is on. When an induced draft blower is provided, no draft hood is needed.

Figure 5:
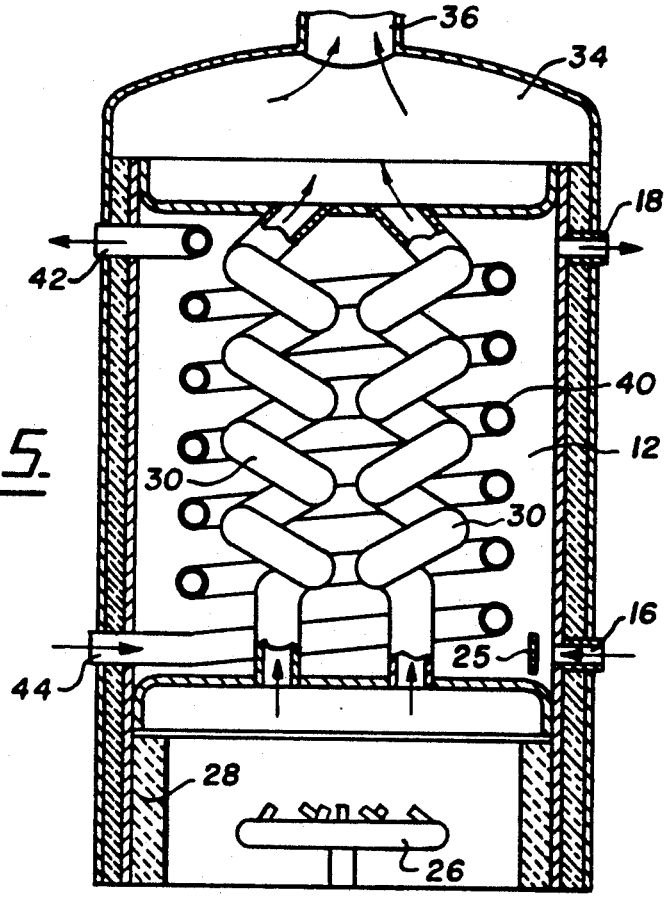
FIG. 5 is an elevational cross-sectional view showing a further embodiment of a multiple boiler.

FIG. 5 shows another embodiment of a multiple boiler wherein the columns 30 are spiral in shape and do not require turbulators 32 therein. By making the columns 30 spiral, the flue gases flow turbulently therein and provide more heat transfer surfaces in the columns 30, so the heat transfer from the flue gases to the columns 30 and consequently to the water within the tank 12 is maximized.

Figure 6:
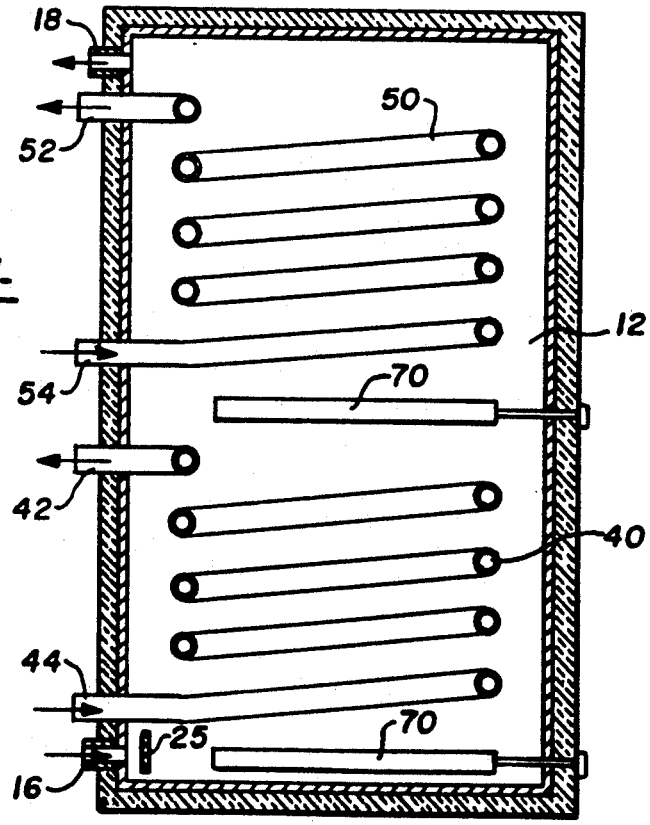
FIG. 6 is an elevational cross-sectional view showing yet a further embodiment of a multiple boiler.

Another embodiment is shown in FIG. 6 wherein an insulated tank 12 has a first helical coil 40 and a second helical coil 50 therein and two electric heating elements 70 are shown immersed within the tank. Thermostats (not shown) are provided so that the water within the tank 12 is kept at a predetermined temperature by the electric heaters 70. The two separate heating systems 40 and 50 provide water, glycol, heating oil, brine, whatever is required for different purposes. In the embodiment shown in FIG. 6, the heat from the electric heaters 70 heats the water in the tank, and the tank water then in turn heats the circulating coils 40 and 50. The temperature of water is controlled by thermostats (not shown).

In another embodiment the lower circulating coil 40 is connected to a separate heating system to circulate a heating medium therethrough. The circulating coil 40 then becomes a heating coil which provides a second source of heat to the tank 12. However the water in the tank 12 is heated only in the tank. When the circulating coil 40 becomes a heating coil to apply heat to the water in the tank, the flow direction is generally reversed with the liquid entering at the outflow pipe 42 and exiting at the inflow pipe 44.

Figure 7:
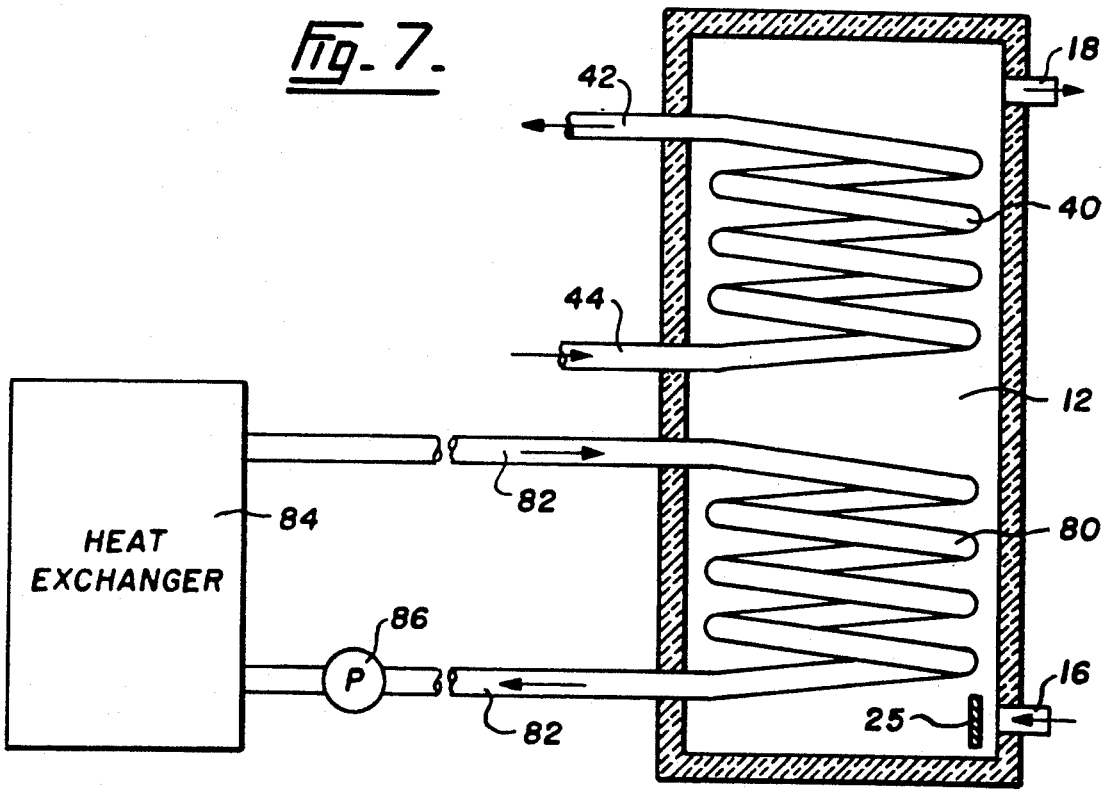
FIG. 7 is an elevational cross-sectional view showing a still further embodiment of a multiple boiler.

In yet a further embodiment, there is provided an insulated tank 12 as shown in FIG. 7 with a helical coil 40 positioned in the upper part of the tank 12 with an inflow pipe 44 at the bottom of the coil 40 and an outflow pipe 42 at the bottom of the coil 40. Water or other liquid heated in the coil 40 is used for hot water, heating or other purposes. The tank 12 has a water inlet connection 16 adjacent the bottom and a water outlet connection 18 adjacent the top. Water is heated in the tank and used for heating the building or other uses as desired.

The water is heated in the tank by a separate heating coil 80 which is connected by pipes 82 to an external heating system. Heating occurs in a separate heat exchanger which does not form part of the present invention. A pump 86 circulates the liquid in the pipes 82 between the heat exchanger 84 and the heating coil 80 in the tank 12 to give up heat to the water in the tank 12.

Figure 8:
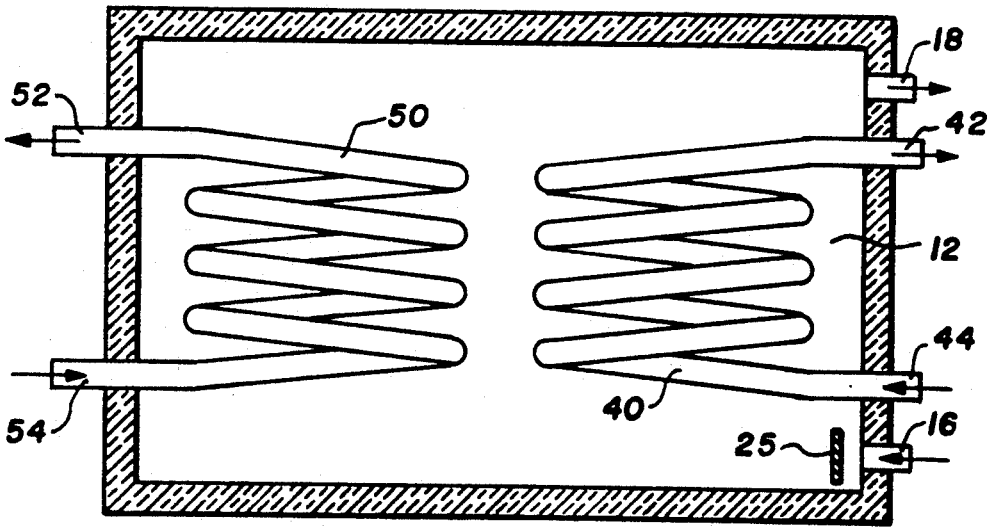
FIG. 8 is an elevational cross-sectional view showing a multiple boiler with two circulating coils side-by-side.

In another embodiment a stubby tank 12 may be used as shown in FIG. 8, and in this case a first coil 40 and a second coil 50 are shown side-by-side. In another embodiment the two coils 40,50 may be interlocked together. Heating the tank 12 is by any of the methods disclosed.

Figure 9:
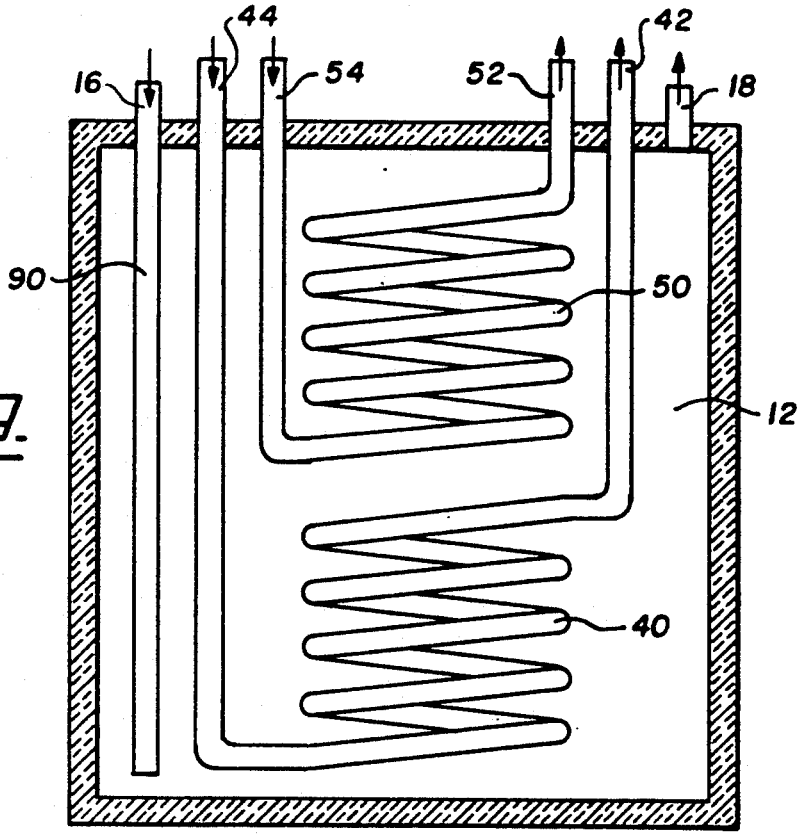
FIG. 9 is an elevational cross-sectional view showing a multiple boiler with all connections being at the top of the boiler.

The embodiment shown in FIG. 9 shows the tank 12 with two coils 40 and 50 therein, and all the connections are made through the top of the tank. The tank inlet 16 is connected to a pipe 90 which extends down to the bottom of the tank 12 so the water enters the tank at the bottom. The tank outlet 18 is at the top of the tank. The inflow pipes 44,54 and outflow pipes 42,52 are at the top of the tank and have extension pipes to support the coils 40,50 in the tank. The heating of water in the tank 12 is by any one or a combination of methods disclosed.

Figure 10:
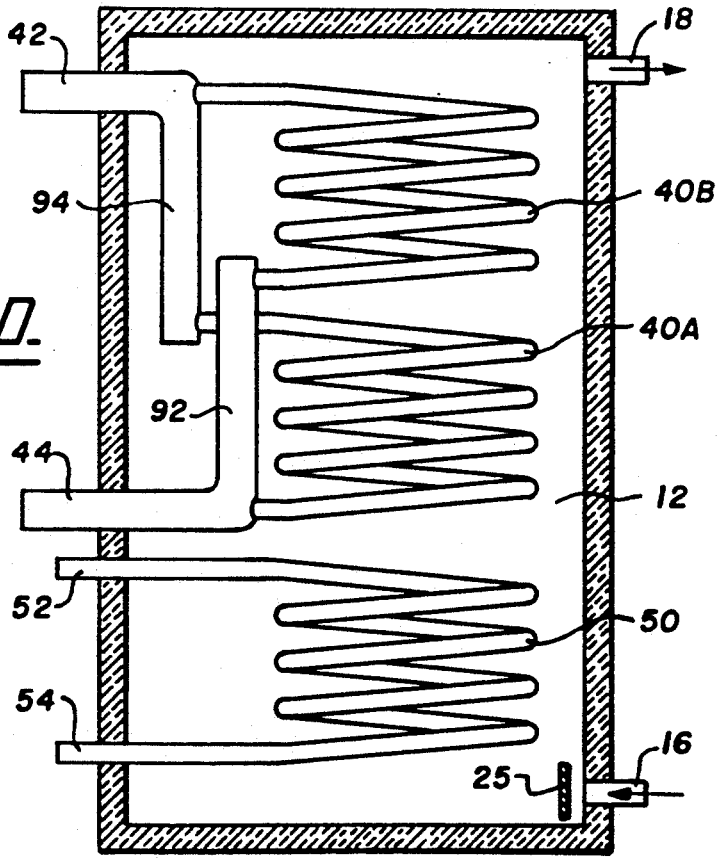
FIG. 10 is an elevational cross-sectional view showing a multiple boiler with one of the circulating coils being a double coiled joined by headers.

In some cases, as shown in FIG. 10, the coils, be they circulating coils for applying heat to the tank, or for absorbing heat from the water in the tank, have an inflow header 92 connected to the inflow pipe 44 and an outflow header 94 connected to the outflow pipe 42. Two coils 40A,40B are connected between the inflow header 92 and the outflow header 94. The coils 40A,40B are generally smaller diameter than the headers 92,94 and provide more heat transfer surface either for heating or for being heated. The diameters of the pipes in the coils 40A,40B may be different. In FIG. 10 the direction of flow in the circulating coils 40A, 40B and 50 depends on whether they are applying heat to the tank or are for absorbing heat from the tank.

Figure 11:
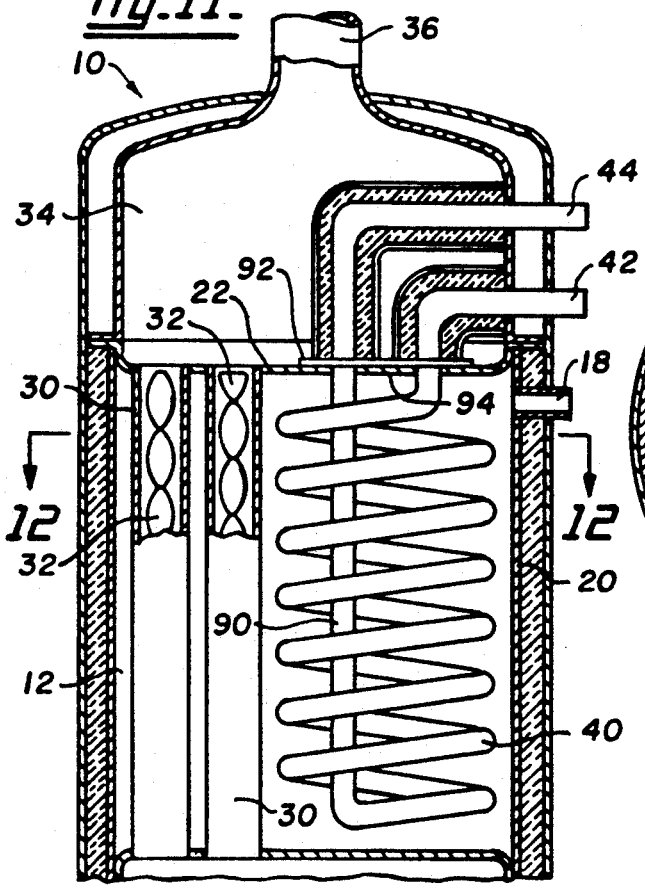
FIG. 11 is an elevational cross-sectional view of an embodiment of a multiple boiler with removable circulating coils.
Figure 12:
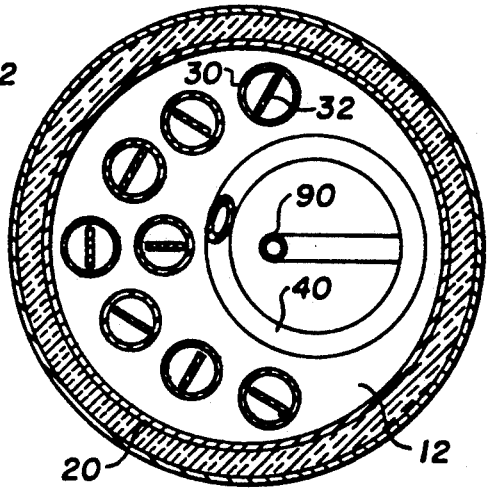
FIG. 12 is a sectional view taken at 12—12 of FIG. 11.

In the embodiment shown in FIGS. 11 and 12 the coil 40 is a tight coil and has an inflow pipe 90 in the centre connected to inflow connection 44. The coil 40 is not about any heating columns 30 and has at the top a flange plate 92 fitting over an aperture 94 in the top plate 22. The flange plate 92 is bolted and sealed to the top plate, however, the coil assembly 40 may be completely removed through the aperture 94 for replacement or servicing. The inflow connection 44 and outflow connection 42 have elbows that extend in through the side of the boiler and are insulated within the flue gas collection area 34.

Figure 13:
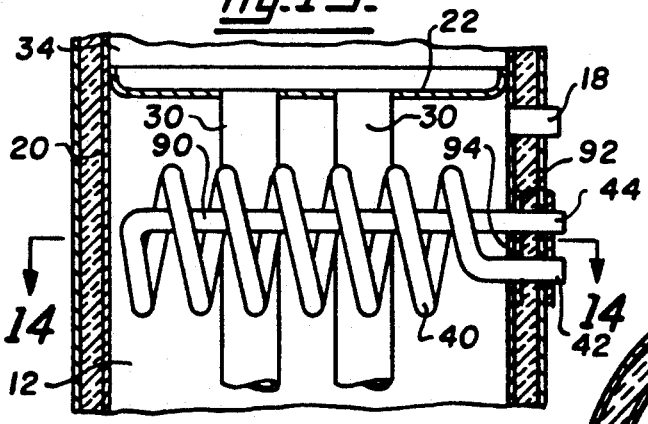
FIG. 13 is an elevational cross-sectional view of an embodiment of a multiple boiler with horizontal circulating coils.
Figure 14:
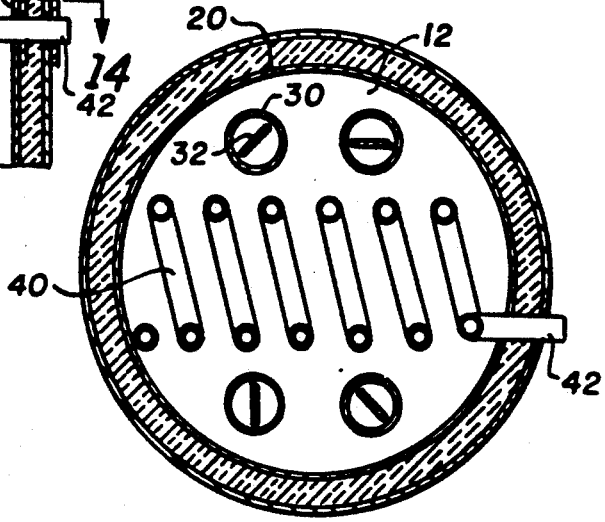
FIG. 14 is a sectional view taken at 14—14 of FIG. 13.

In FIGS. 13 and 14, the coil 40 is shown having a horizontal axis and an aperture 94 is provided in the cylindrical side wall 20 of the tank, which is sealed by the flange plate 92. The coil assembly may be removed and replaced through the aperture 94 and fits between heating columns 30 which are strategically located in the tank so as to not interfere with the coil assembly 40.

The simplicity of the heating system utilizing a hot water tank with a single heating source provides multiple heating systems for different purposes either in a single residence, apartment block, condominium and the like, or, alternatively, for a commercial building. By utilizing a hot water tank wherein the water is heated while in the tank, one avoids the necessities of more complex type heating systems where water is taken from the tank and heated in a separate heat exchanger and then returned to the tank.

Various changes may be made to the embodiments shown herein without departing from the scope of the present invention which is limited only by the following claims.

The embodiments of the present invention in which an exclusive property or privilege is claimed are defined as follows:

1. A multiple boiler comprising:

an insulated water tank having a water tank inlet and a water tank outlet;

heating means to heat the water in the tank without circulating water outside the tank, and at least two circulating coils in the tank, each of the coils having an inflow and an outflow, the circulating coils being in heat exchange relationship with water in the tank.

2. The multiple boiler according to claim 1 wherein the two circulating coils are positioned one on top of each other each within the tank.

3. The multiple boiler according to claim 1 wherein the two circulating coils are positioned side-by-side.

4. The multiple boiler according to claim 1 wherein the coils are coiled about a vertical axis.

5. The multiple boiler according to claim 4 wherein the inflows are at the bottom of the coils and the outflows are at the top of the coils.

6. The multiple boiler according to claim 1 wherein the two circulating coils are connected by header means to a single inflow and a single outflow.

7. The multiple boiler according to claim 1 wherein the water tank inlet, the water tank outlet, the inflows and outflows all pass through the top of the tank.

8. The multiple boiler according to claim 1 wherein the heating means comprises at least one electrical immersion heater inside the tank.

9. The multiple boiler according to claim 1 wherein the heating means to heat the water in the tank includes a heating coil inserted in the tank below the at least two circulating coils, and wherein a circulation of liquid in the heating coil occurs from an external heating source.

10. The multiple boiler according to claim 1 wherein the heating means includes a first heating system comprising at least one electrical immersion heater inside the tank and a second heating system comprising a heating coil inserted in the tank below the at least two circulating coils, and wherein a circulation of liquid in the heating coil occurs from an external heating source.

11. The multiple boiler according to claim 1 wherein each of the circulating coils in the tank is removable through an aperture in the tank, the aperture having sealing means to seal the aperture with the circulating coil within the tank.

12. A multiple boiler comprising:

an insulated water tank having a water tank inlet and a water tank outlet;

heating means located beneath the tank to heat water in the tank without circulating water outside the tank;

flue column means passing from the bottom of the tank through the tank to the top of the tank for flue gases from the heating means, and at least two circulating coils in the tank, each of the circulating coils having an inflow and an outflow, the circulating coils being in heat exchange relationship with water in the tank.

13. The multiple boiler according to claim 12 wherein the two coils are positioned one about the other within the water tank.

14. The multiple boiler according to claim 12 wherein the two coils are positioned side-by-side.

15. The multiple boiler according to claim 12 wherein the heating means is selected from the group consisting of solid fuel heater, gas fired burner, oil fired burner and power burner.

16. The multiple boiler according to claim 12 wherein the flue column means comprises a plurality of columns, each column having a turbulation means therein to provide turbulation for flue gases and maximize heat transfers, the columns being substantially straight.

17. The multiple boiler according to claim 12 wherein the water tank inlet is adjacent the bottom of the tank, and the water tank outlet is adjacent the top of the tank.

18. The multiple boiler according to claim 12 wherein the inflow for each of the circulating coils is positioned below the outflow.

19. The multiple boiler according to claim 12 wherein the flue column means comprises a plurality of columns, each column being curved to provide turbulation for flue gases and increase contact area between flue gases and walls of the columns to maximize heat transfer.

20. The multiple boiler according to claim 12 wherein the top of the tank is dished inwards.

21. The multiple boiler according to claim 12 wherein the top of the tank is convex shaped.

22. The multiple boiler according to claim 12 wherein the top of the tank is concave shaped.

23. The multiple boiler according to claim 16 including flue gas containment area above the tank connecting to a stack.

24. The multiple boiler according to claim 23 including a draft hood on the stack to increase draft, and assist in stable combustion for the heating means.

25. The multiple boiler according to claim 24 wherein the draft hood is a low profile draft hood.

26. The multiple boiler according to claim 24 wherein a damper is provided in the stack above the draft hood.

27. The multiple boiler according to claim 23 wherein an induced draft blower is connected to the stack to provide an induced draft in the gas containment area.

28. The multiple boiler according to claim 1 wherein one of the two circulating coils in the tank comprises the heating means to heat the water in the tank.

* * * * *